US009293097B2

(12) United States Patent
Kim et al.

(10) Patent No.: US 9,293,097 B2
(45) Date of Patent: Mar. 22, 2016

(54) DISPLAY APPARATUS

(75) Inventors: Ji-Sun Kim, Seoul (KR); Yeong-Keun Kwon, Yongin-si (KR); Soo-Wan Yoon, Hwaseong-si (KR); Young-Soo Yoon, Anyang-si (KR); Jaehoon Lee, Seoul (KR); Chongchul Chai, Seoul (KR)

(73) Assignee: SAMSUNG DISPLAY CO., LTD. (KR)

( * ) Notice: Subject to any disclaimer, the term of this patent is extended or adjusted under 35 U.S.C. 154(b) by 684 days.

(21) Appl. No.: 13/419,726

(22) Filed: Mar. 14, 2012

(65) Prior Publication Data

US 2013/0093739 A1 Apr. 18, 2013

(30) Foreign Application Priority Data

Oct. 12, 2011 (KR) ..... 10-2011-0104254

(51) Int. Cl.
*G09G 5/00* (2006.01)
*G09G 3/36* (2006.01)

(52) U.S. Cl.
CPC ..... *G09G 3/3648* (2013.01); *G09G 3/3614* (2013.01); *G09G 2300/0426* (2013.01); *G09G 2300/0434* (2013.01)

(58) Field of Classification Search
None
See application file for complete search history.

(56) References Cited

U.S. PATENT DOCUMENTS

| | | | | |
|---|---|---|---|---|
| 7,567,228 | B1 | 7/2009 | Wen et al. | |
| 7,629,955 | B2 | 12/2009 | Asao et al. | |
| 2007/0103631 | A1 * | 5/2007 | Moon et al. | 349/139 |
| 2008/0224980 | A1 | 9/2008 | Senda et al. | |
| 2010/0079363 | A1 | 4/2010 | Chung et al. | |
| 2010/0156954 | A1 * | 6/2010 | Kim et al. | 345/690 |
| 2011/0169874 | A1 * | 7/2011 | Jang et al. | 345/690 |
| 2012/0044225 | A1 * | 2/2012 | Kim et al. | 345/209 |
| 2012/0098871 | A1 * | 4/2012 | Park et al. | 345/690 |
| 2012/0105785 | A1 * | 5/2012 | Kim et al. | 349/139 |
| 2012/0120035 | A1 * | 5/2012 | Yang et al. | 345/205 |

* cited by examiner

*Primary Examiner* — Adam R Giesy
*Assistant Examiner* — Henok Heyi
(74) *Attorney, Agent, or Firm* — Cantor Colburn LLP

(57) ABSTRACT

A display apparatus includes gate lines, data lines insulated from the gate lines while crossing the gate lines, and pixels each including sub-pixels in two successive rows by three successive columns. Among the sub-pixels in the two rows by the three columns, the sub-pixels in one of the three columns are respectively connected to a pair of different gate lines among three gate lines, and the sub-pixels in a different one of the three columns are connected to a remaining gate line among the three gate lines. The sub-pixels in the one and the different one of the three columns includes the same color filter and are applied with a gate signal transmitted in the same direction along pixel rows.

20 Claims, 8 Drawing Sheets

DISPLAY APPARATUS

This application claims priority to Korean Patent Application No. 10-2011-0104254 filed on Oct. 12, 2011, and all the benefits accruing therefrom under 35 U.S.C. §119, the contents of which are herein incorporated by reference in its entirety.

BACKGROUND OF THE INVENTION

1. Field of the Invention

The invention relates to a display apparatus. More particularly, the invention relates to a display apparatus capable of improving its display quality.

2. Description of the Related Art

In general, a display apparatus includes pixel electrodes, switching devices respectively connected to the pixel electrodes, gate lines respectively connected to the switching devices, and data lines respectively connected to the switching devices.

The gate lines apply gate signals to the switching devices to turn on the switching devices, and the data lines apply data signals to the pixel electrodes through the turned-on switching devices. To this end, the display apparatus includes a gate driver applying the gate signals to the gate lines and a data driver applying the data signals to the data lines.

A display apparatus employing two gate drivers has been researched and developed. One of the two gate drivers applies the gate signals to a part of the gate lines and the other of the two gate drivers applies the gate signals to a remaining part of the gate lines.

BRIEF SUMMARY OF THE INVENTION

Exemplary embodiments of the invention provide a display apparatus capable of improving its display quality.

According to the exemplary embodiments, a display apparatus includes a first substrate including a display area which displays an image and a non-display area disposed adjacent to at least a portion of the display area, a plurality of gate lines which is disposed on the first substrate and receives a gate signal, a plurality of data lines which is disposed on the first substrate and receives a data signal, the data lines being insulated from the gate lines while crossing the gate lines, and a plurality of pixels disposed on the first substrate, each of the pixels including sub-pixels arranged in two rows by three columns. Among the sub-pixels arranged in the two rows by the three columns, the sub-pixels arranged in one of the three columns are respectively connected to a first pair of different gate lines among three successive gate lines, and the sub-pixels arranged in a different one of the three columns are connected to a remaining gate line among the three gate lines. The sub-pixels arranged in a remaining one of the three columns are respectively connected to a second pair of different gate lines among the three gate lines.

The sub-pixels arranged in a same column are connected to two data lines, which are respectively disposed at a left side and a right side of the sub-pixels arranged in the same column, among the data lines.

The gate lines are divided into odd-numbered gate lines and even-numbered gate lines, and the odd-numbered gate lines transmit the gate signal to a first direction different from a second direction to which the even-numbered gate lines transmit the gate signal.

The data lines are divided into odd-numbered data lines and even-numbered data lines, the odd-numbered data lines receive the data signal having a positive polarity or a negative polarity, and the even-numbered data lines receive the data signal having a polarity different from that of the odd-numbered data lines.

The display apparatus further includes a first gate driver which is disposed in the non-display area and applies the gate signal to the odd-numbered gate lines and a second gate driver which is disposed in the non-display area and applies the gate signal to the even-numbered gate lines.

Each of the sub-pixels arranged in a single one of the three columns includes a red color filter, each of the sub-pixels arranged in a different single one of the three columns includes a green color filter, and each of the sub-pixels arranged in a remaining single one of the three columns includes a blue color filter.

The first gate driver sequentially applies the gate signal to the odd-numbered gate lines, the second gate driver sequentially applies the gate signal to the even-numbered gate lines, and the second gate driver applies the gate signal to a first gate line of the even-numbered gate lines after the first gate driver applies the gate signal to a first gate line of the odd-numbered gate lines.

The first gate driver sequentially applies the gate signal to the gate lines which transmit the gate signal in the first direction, the second gate driver sequentially applies the gate signal to the gate lines which transmit the gate signal in the second direction.

The display apparatus further includes a second substrate facing the first substrate and a liquid crystal layer interposed between the first substrate and the second substrate.

Each of the sub-pixels arranged in the two rows by the three columns includes a thin film transistor which outputs the data signal in response to the gate signal, a pixel electrode including a first portion, a second portion bent from the first portion and a plurality of slits, where the pixel electrode receives the data signal, and a common electrode disposed between the thin film transistor and the pixel electrode.

The thin film transistor includes a gate electrode which protrudes from one of the gate lines when viewed in a plan view, an active layer disposed on the gate electrode, a source electrode which is disposed on the active layer, protrudes from one of the data lines when viewed in the plan view and partially overlaps with the gate electrode, and a drain electrode which is disposed on the active layer, spaced apart from the source electrode and overlaps with the gate electrode in a width direction of the gate electrode.

The active layer includes a metal oxide material having a semiconductor property A planar area of the first portion of the pixel electrode is greater than a planar area of the second portion of the pixel electrode.

Each of the gate lines includes a first line portion disposed adjacent to a first side of the pixel electrode in a plan view, a second line portion disposed adjacent to a second side of the pixel electrode in a plan view, and a connection line portion which is disposed in the non-display area and connects the first line portion and the second line portion.

One of the sub-pixels arranged in the different one of the three columns is connected to the first line portion and a remaining one of the sub-pixels arranged in the different one of the three columns is connected to the second line portion. A planar area of the first portion is the same as a planar area of the second portion.

According to the above, a polarity arrangement of the data signals applied to the pixel electrodes may be optimized, thereby improving the display quality of the display apparatus.

In addition, since a capacitance between the gate electrode and the drain electrode of the thin film transistor is uniformly maintained and a parasitic capacitance occurring between the data lines and the pixel electrodes is reduced, the display quality of the display apparatus may be improved.

BRIEF DESCRIPTION OF THE DRAWINGS

The above and other advantages of the invention will become readily apparent by reference to the following detailed description when considered in conjunction with the accompanying drawings wherein.

DETAILED DESCRIPTION OF THE INVENTION

Figure 1:
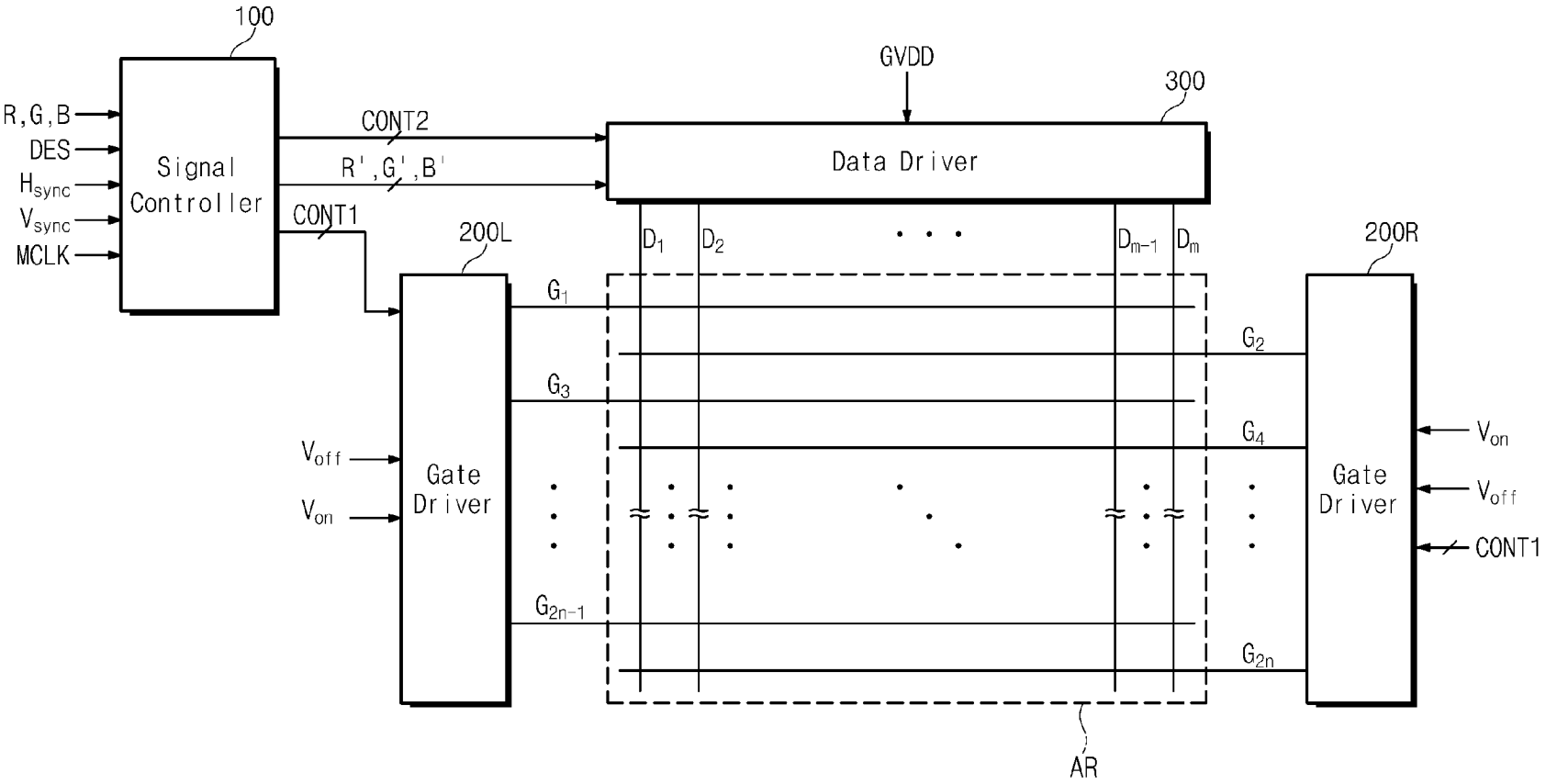
FIG. 1 is a block diagram showing an exemplary embodiment of a display apparatus according to the invention.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

It will be understood that when an element or layer is referred to as being "on" or "connected to" another element or layer, it can be directly on or connected to the other element or layer or intervening elements or layers may be present. In contrast, when an element is referred to as being "directly on" or "directly connected to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "lower" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a," "an" and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the invention will be explained in detail with reference to the accompanying drawings.

Figure 2:
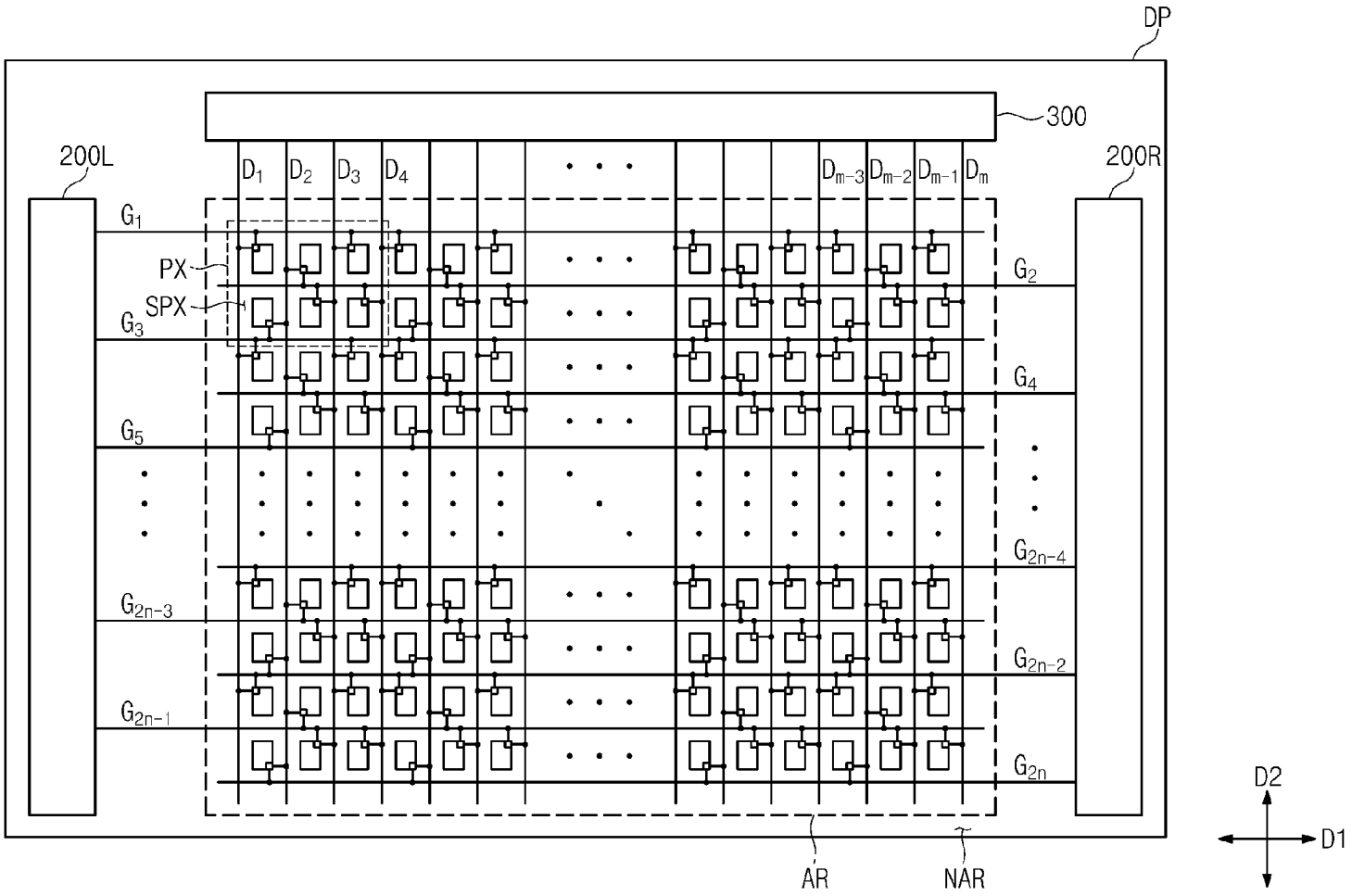
FIG. 2 is a plan view showing an exemplary embodiment of a display panel shown in FIG. 1.
Figure 3:
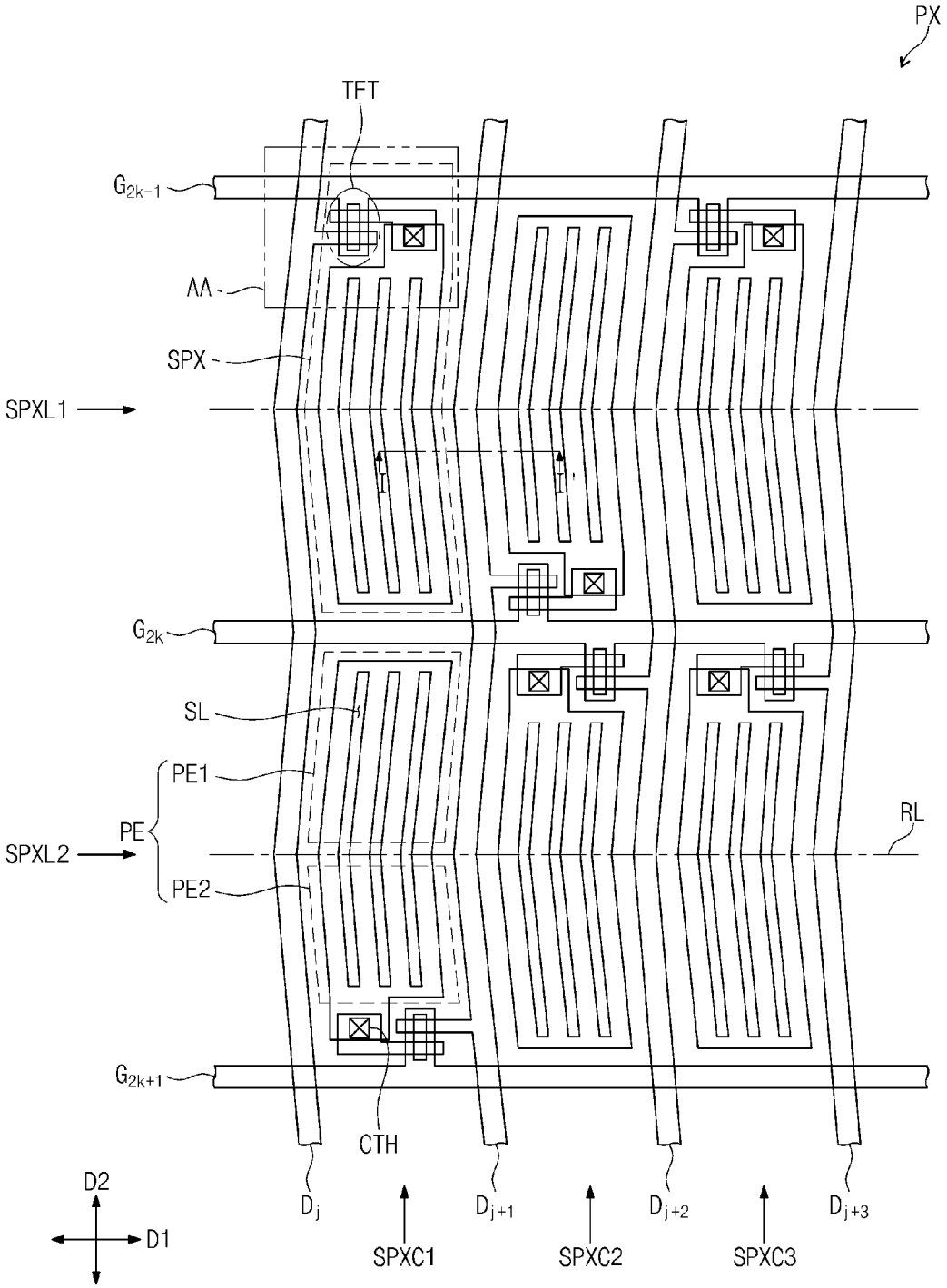
FIG. 3 is an enlarged plan view showing an exemplary embodiment of a pixel shown in FIG. 2.
Figure 4:
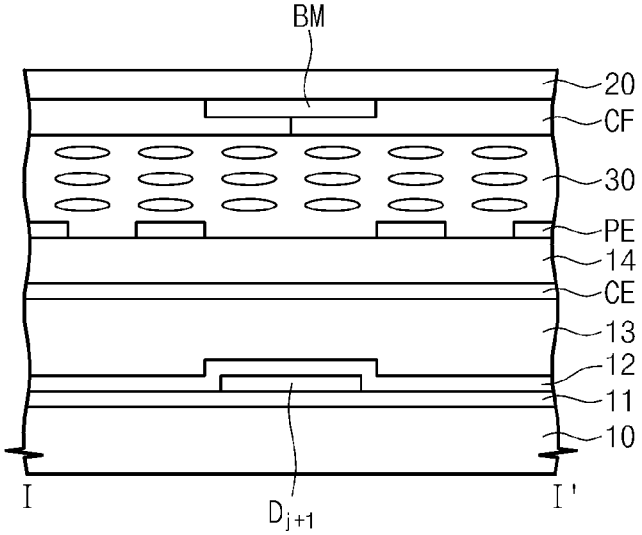
FIG. 4 is a cross-sectional view taken along line I-I' shown in FIG. 3.
Figure 5:
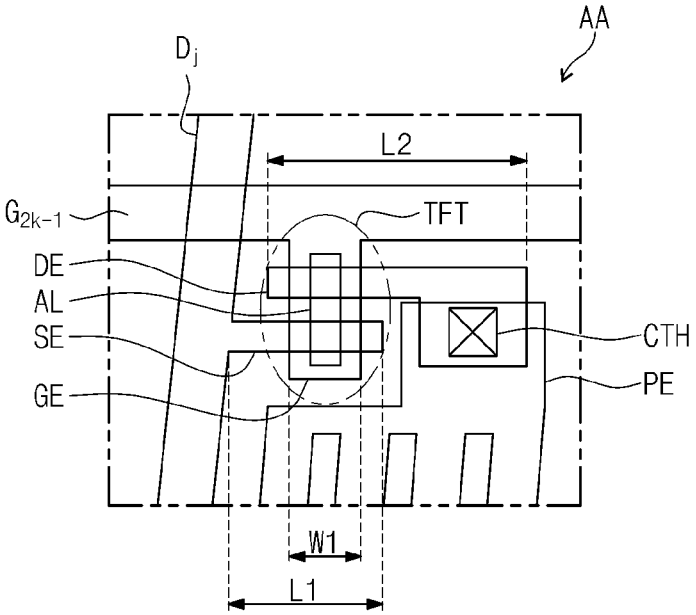
FIG. 5 is an enlarged plan view showing portion AA shown in FIG. 3.

FIG. 1 is a block diagram showing an exemplary embodiment of a display apparatus according to the invention, FIG. 2 is a plan view showing an exemplary embodiment of a display panel shown in FIG. 1, FIG. 3 is an enlarged plan view showing an exemplary embodiment of a pixel shown in FIG. 2, FIG. 4 is a cross-sectional view taken along line I-I' shown in FIG. 3, and FIG. 5 is an enlarged plan view showing portion AA shown in FIG. 3.

Referring to FIGS. 1 to 4, a display apparatus includes a display panel DP, a signal controller 100, gate drivers 200R and 200L, and a data driver 300.

The display panel DP displays an image. The display panel DP may be various display panels, such as a liquid crystal display panel, an organic light emitting display panel, an electrophoretic display panel, an electrowetting display panel, etc. In the exemplary embodiment, the liquid crystal display panel will be described as the display panel DP as a representative example.

As shown in FIGS. 2 to 5, the display panel DP includes a first substrate 10, a second substrate 20 facing the first substrate 10, and a liquid crystal layer 30 interposed between the first substrate 10 and the second substrate 20.

Referring to FIG. 2, a plurality of first lines is disposed on the first substrate 10 to be extended in a first direction D1 and a plurality of second lines is disposed on the first substrate 10 to be extended in a second direction D2 crossing the first direction D1. In the exemplary embodiment, the first lines are referred to as gate lines $G_1$ to $G_{2n}$ and the second lines are referred to as data lines $D_1$ to $D_m$.

The first substrate 10 includes a display area AR in which an image is displayed and a non-display area NAR disposed adjacent to at least a portion of the display area AR. The display area AR includes a plurality of pixels PX arranged therein. Each of the pixels PX includes a plurality of sub-pixels SPX. In one exemplary embodiment, as an example, each pixel PX may include the sub-pixels SPX arranged in two rows by three columns.

As shown in FIGS. 2 to 5, each sub-pixel SPX includes a thin film transistor TFT, a pixel electrode PE, and a common electrode CE. The common electrode CE may be disposed between the thin film transistor TFT and the pixel electrode PE in a cross-sectional of the display panel DP.

FIGS. 3 to 5 show one pixel among the pixels PX as a representative example. Hereinafter, the pixel electrode PE and the sub-pixels SPX will be described with reference to FIGS. 3 to 5.

The thin film transistor TFT is connected to a corresponding gate line of the gate lines $G_1$ to $G_{2n}$ and a corresponding data line of the data lines $D_1$ to $D_m$. The thin film transistor TFT serves as a switching device to output a data signal in response to a gate signal.

The gate lines $G_1$ to $G_{2n}$ are disposed on the first substrate 10. The thin film transistor TFT includes a gate electrode GE branched from the corresponding gate line of the gate lines $G_1$ to $G_2$. That is, the gate electrode GE has a protruded shape protruded from the corresponding gate line of the gate lines $G_1$ to $G_{2n}$.

A gate insulating layer 11 is disposed on the first substrate 10 to cover the gate lines $G_1$ to $G_{2n}$ and the gate electrode GE.

The thin film transistor TFT includes an active layer AL disposed on the gate electrode GE while interposing the gate insulating layer 11 therebetween. When viewed in a plan view, the active layer AL is overlapped with the gate electrode GE. The active layer AL may include a metal oxide material having a semiconductor property. In other words, the active layer AL includes at least one of zinc oxide, zinc tin oxide, indium zinc oxide, gallium zinc oxide or zinc indium gallium oxide.

The data lines $D_1$ to $D_m$ are disposed on the gate insulating layer 11. The thin film transistor TFT includes a source electrode SE branched from the corresponding data line of the data lines $D_1$ to $D_m$. The source electrode SE is partially overlapped with the gate electrode GE and the active layer AL in a plan view. In the exemplary embodiment, for instance, as shown in FIG. 5, the source electrode SE has a length L1 in the first direction D1 larger than a width W1 in the first direction D1 of the gate electrode GE and crosses the gate electrode GE when viewed in a plan view.

In addition, the thin film transistor TFT includes a drain electrode DE spaced apart from the source electrode SE when viewed in a plan view. The drain electrode DE is partially overlapped with the gate electrode GE and the active layer AL in the plan view as is the source electrode SE. In the exemplary embodiment, as an example, the drain electrode DE has a length L2 in the first direction D1 larger than the width W1 of the gate electrode GE and crosses the gate electrode GE in the plan view.

When the drain electrode DE and the source electrode SE cross the gate electrode GE in the plan view, a capacitance between the drain electrode DE and the gate electrode GE and a capacitance between the source electrode SE and the gate electrode GE are uniform. Accordingly, a variance of kick-back voltage occurring on the sub-pixels SPX may be reduced.

A protective layer 12 and an organic layer 13 are sequentially disposed on the first substrate 10 to protect the drain electrode DE, the source electrode SE and the data lines $D_1$ to $D_m$. The protective layer 12 may be omitted.

The organic layer 13 includes an organic material such as an acryl resin to serve as a planarization layer. The common electrode CE is disposed on the organic layer 13. The common electrode CE may be disposed on the organic layer 13 except for an area corresponding to a contact hole CTH.

An insulating layer 14 is disposed on the common electrode CE, and the pixel electrode PE is disposed on the insulating layer 14. As shown in FIG. 4, since the common electrode CE is disposed between the thin film transistor TFT and the pixel electrode PE, and between the pixel electrode PE and the data lines $D_1$ to $D_m$, a parasitic capacitance caused by the pixel electrode PE may be reduced.

The pixel electrode PE is connected to the drain electrode DE through the contact hole CTH as shown in FIGS. 3 to 5. The pixel electrode PE receives the data signal through the drain electrode DE.

The pixel electrode PE includes a plurality of slits SL, and is a single, continuous, indivisible member. In one exemplary embodiment, for instance, the pixel electrode PE may include three slits as shown in FIG. 3. In addition, the pixel electrode PE may be divided into two portions, e.g., first and second portions PE1 and PE2. When viewed in a plan view, the second portion PE2 is bent from the first portion PE1. The first portion PE1 and the second portion PE2 are inclined by a predetermined angle with respect to a reference lien RL. The first portion PE1 and the second portion PE2 have different areas from each other. In the exemplary embodiment, the first portion PE1 may have a planar area larger than that of the second portion PE2 as shown in FIG. 3. The reference line RL is positioned at the same position of each of the sub-pixels arranged in the same row among the sub-pixels SPX arranged in two rows by three columns.

In the sub-pixels SPX arranged in adjacent columns to each other among the sub-pixels SPX arranged in the same row, the first portion PE1 and the second portion PE2 may be differently arranged in different positions. In detail, the first portion PE1 and the second portion PE2 of the sub-pixel SPX arranged in a first column SPXC1 among the sub-pixels SPX arranged in a second row SPXL2 are respectively positioned at an upper position and a lower position with reference to the reference line RL. The first portion PE1 and the second portion PE2 of the sub-pixel SPX arranged in a second column SPXC2 among the sub-pixels SPX arranged in the second row SPXL2 are respectively positioned at the lower position and the upper position with reference to the reference line RL. The first portion PE1 and the second portion PE2 of the sub-pixel SPX arranged in a third column SPXC3 among the sub-pixels SPX arranged in the second row SPXL2 are respectively positioned at the lower position and the upper position with reference to the reference line RL.

The sub-pixels SPX may further include color filters CF, respectively. The color filters CF respectively disposed in the sub-pixels SPX may have different colors from each other.

Among the sub-pixels SPX arranged in two rows by three columns, the sub-pixels SPX arranged in one of three columns include a red color filter, the sub-pixels arranged in one of three columns include a green color filter, and the sub-pixels arranged in one of three columns include a blue color filter.

Figure 6:
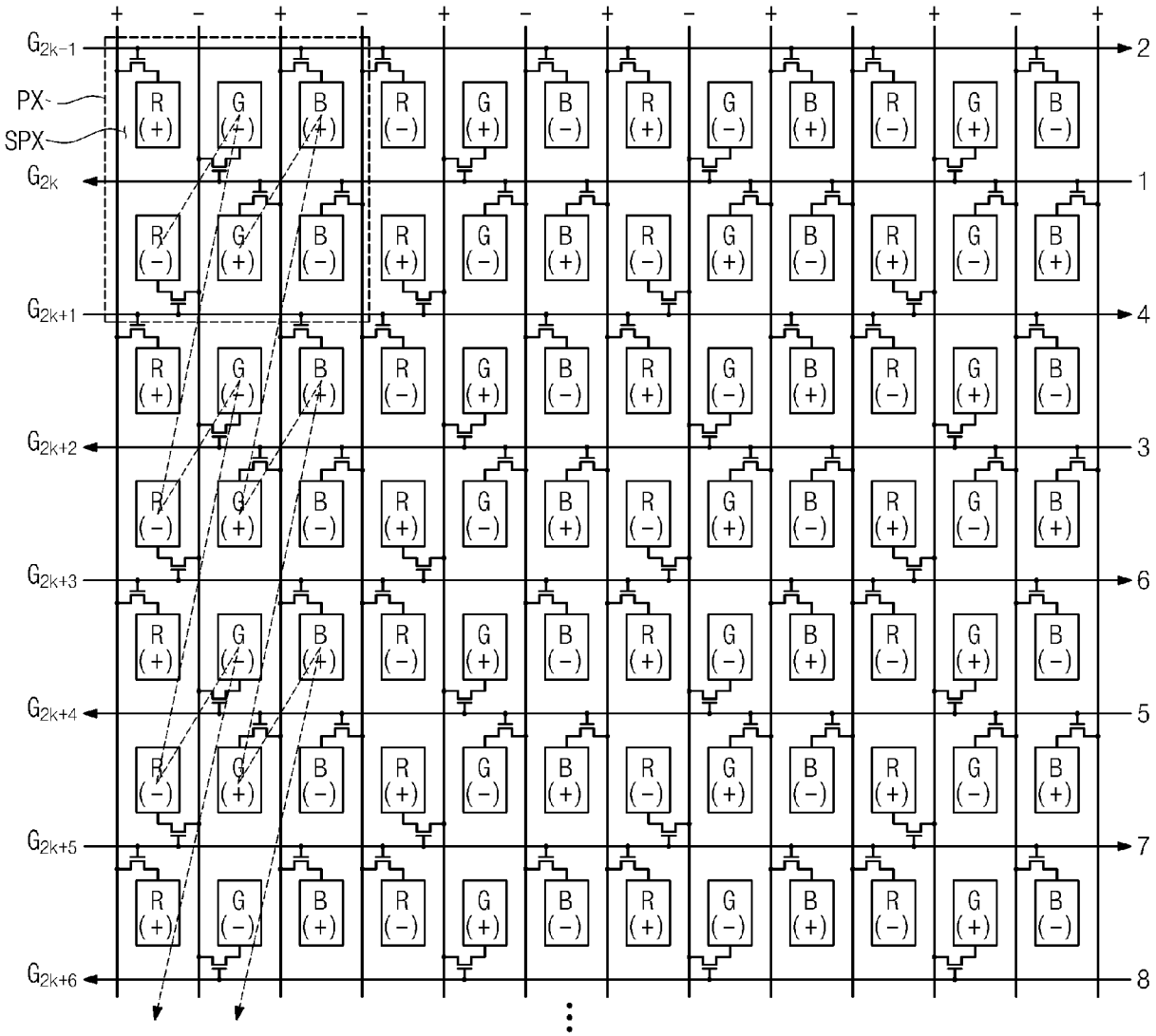
FIG. 6 is a plan view showing an exemplary embodiment of polarities of pixels shown in FIG. 2.

In one exemplary embodiment, for instance, each of the sub-pixels SPX arranged in the first column SPXC1 includes the red color filter R (refer to FIG. 6), each of the sub-pixels SPX arranged in the second column SPXC2 includes the green color filter G (refer to FIG. 6), and each of the sub-pixels SPX arranged in the third column SPXC3 includes the blue color filter B (refer to FIG. 6).

The color filters CF may be disposed on the second substrate 20 facing the first substrate 10 while interposing the liquid crystal layer 30 therebetween. The color filters CF respectively corresponding to the sub-pixels SPX may be disposed corresponding to the pixel electrodes PE. Each of the color filters CF may have the same planar area as and face a corresponding pixel electrode of the pixel electrodes PE.

A black matrix BM is disposed on the second substrate 20. The black matrix BM is disposed corresponding to and overlapping the data lines $D_1$ to $D_m$. The color filters CF adjacent to each other in the plan view with reference to the black matrix BM, may make contact with each other, as illustrated in FIG. 4.

In the exemplary embodiment, the common electrode CE is disposed on the first substrate 10 and the color filters CF are disposed on the second substrate 20, but they should not be limited thereto or thereby. That is, the common electrode CE and the color filters CF may be disposed on the second substrate 20 and the first substrate 10, respectively.

Hereinafter, a connection structure between the sub-pixels SPX, the gate lines $G_1$ to $G_{2n}$, and the data lines $D_1$ to $D_m$ will be described in detail with reference to FIGS. 2 and 3.

Among the sub-pixels SPX of a single pixel PX arranged in two rows by three columns, the sub-pixels SPX arranged in one of three columns are respectively connected to two gate lines among three gate lines that are successively arranged. In addition, the sub-pixels SPX arranged in one of three columns are connected to a remaining gate line among the three successive gate lines. In this case, the expression that "the sub-pixel is connected to the gate line" means that the thin film transistor included in the sub-pixel is connected to the gate line.

In detail, as shown in FIG. 3, the sub-pixel SPX arranged in the first row SPXL1 and the first column SPXC1 among the sub-pixels SPX is connected to a first gate line $G_{2K-1}$ among three gate lines $G_{2K-1}$, $G_{2K}$ and $G_{2K+1}$, and the sub-pixel SPX arranged in the second row SPXL2 and the first column SPXC1 is connected to a third gate line $G_{2K+1}$ among three gate lines $G_{2K-1}$, $G_{2K}$ and $G_{2K+1}$. The sub-pixel SPX arranged in the first row SPXL1 and the second column SPXC1 and the sub-pixel SPX arranged in the second row SPXL2 and the second column SPXC2 are connected to a same second gate line $G_{2K}$ among the three gate lines $G_{2K-1}$, $G_{2K}$ and $G_{2K+1}$.

The sub-pixels SPX arranged in the third column SPXC3 among the sub-pixels SPX are connected to different two gate lines among the three gate lines $G_{2K-1}$, $G_{2K}$, and $G_{2K+1}$ respectively. In detail, the sub-pixel SPX arranged in the first row SPXL1 and the third column SPXC3 is connected to the first gate line $G_{2K-1}$ and the sub-pixel SPX arranged in the second row SPXL2 and the third column SPXC3 is connected to the second gate line $G_{2K}$.

Two sub-pixels arranged in each of the first, second, and third columns SPXC1, SPXC2, and SPXC3 are connected to two data lines different from each other and adjacent to each other among four successive data lines $D_j$, $D_{j+1}$, $D_{j+2}$, and $D_{j+3}$.

Particularly, as shown in FIG. 3, the two sub-pixels SPX arranged in the first column SPXC1 are respectively connected to first and second data lines $D_j$ and $D_{j+1}$ among the four successive data lines $D_j$, $D_{j+1}$, $D_{j+2}$, and $D_{j+3}$, the two sub-pixels SPX arranged in the second column SPXC2 are respectively connected to second and third data lines $D_{j+1}$ and $D_{j+2}$ among the four successive data lines $D_j$, $D_{j+1}$, $D_{j+2}$, and $D_{j+3}$, and the two sub-pixels SPX arranged in the third column SPXC3 are respectively connected to third and fourth data lines $D_{j+2}$ and $D_{j+3}$ among the four successive data lines $D_j$, $D_{j+1}$, $D_{j+2}$, and $D_{j+3}$.

Referring to FIG. 1 again, the signal controller 100 receives image signals R, G and B and control signals from an external graphic controller (not shown). The control signals include a vertical synchronization signal Vsync, a horizontal synchronization signal Hsync, a main clock signal MCLK, and a data enable signal DES. The signal controller 100 processes the image signals R, G and B and the control signals in consideration of an operation condition of the display panel DP and generates gate control signals CONT1 and data control signals CONT2.

The gate control signals CONT1 are applied to the gate drivers 200L and 200R. The gate control signals CONT1 include a vertical synchronization start signal indicating an output of a gate on pulse (e.g., a high period of the gate signal), a gate clock signal controlling an output timing of the gate on pulse, an output enable signal determining a width of the gate on pulse, etc.

The data control signals CONT2 are applied to the data driver 300. The data signals CONT2 include a horizontal synchronization start signal indicating an input of image data R', G' and B', a load signal indicating an application of the data signals to the data lines $D_1$ to $D_m$, an inverting signal inverting a polarity of the data signals, and a data clock signal.

The display apparatus includes the two gate drivers 200L and 200R. One gate driver (hereinafter, referred to as first gate driver) 200L is connected to a portion of the gate lines $G_1$ to $G_{2n}$ and the other gate driver (hereinafter, referred to as second gate driver) 200R is connected to remaining portion of the gate lines $G_1$ to $G_{2n}$.

The first and second gate drivers 200L and 200R receive the gate control signals CONT1 to apply the gate signal including a gate on voltage Von or a gate off voltage Voff to the gate lines $G_1$ to $G_{2n}$.

The first and second gate drivers 200L and 200R face each other while interposing the display area AR therebetween and may be directly in the non-display area NAR according to embodiments. The gate lines connected to the first gate driver 200L may be odd-numbered gate lines $G_1$ to $G_{2-1}$ and the gate lines connected to the second gate driver 200R may be even-numbered gate lines $G_2$ to $G_{2n}$, however they should not be limited thereto or thereby. That is, the first gate driver 200L may be connected to the even-numbered gate lines $G_2$ to $G_{2n}$ and the second gate driver 200R may be connected to the odd-numbered gate lines $G_1$ to $G_{2n-1}$ according to embodiments.

Each of the first and second gate drivers 200L and 200R includes a plurality of shift registers (not shown). The shift registers are directly on the first substrate 10, and may be formed substantially when the thin film transistor TFT is formed. In one exemplary embodiment, the first and second gate drivers 200L and 200R may be directly on the first substrate 10 during a thin film process for the thin film transistor TFT, instead of mounting separate gate driving chips on the first substrate 10.

The data driver 300 is connected to the data lines $D_1$ to $D_m$ and converts a reference voltage GVDD into the data signals to apply the data signal to the data lines $D_1$ to $D_m$. The data signals applied to the data lines $D_1$ to $D_m$ are applied to the pixel electrodes PE of the sub-pixels SPX through the thin film transistors TFT.

Figure 7:
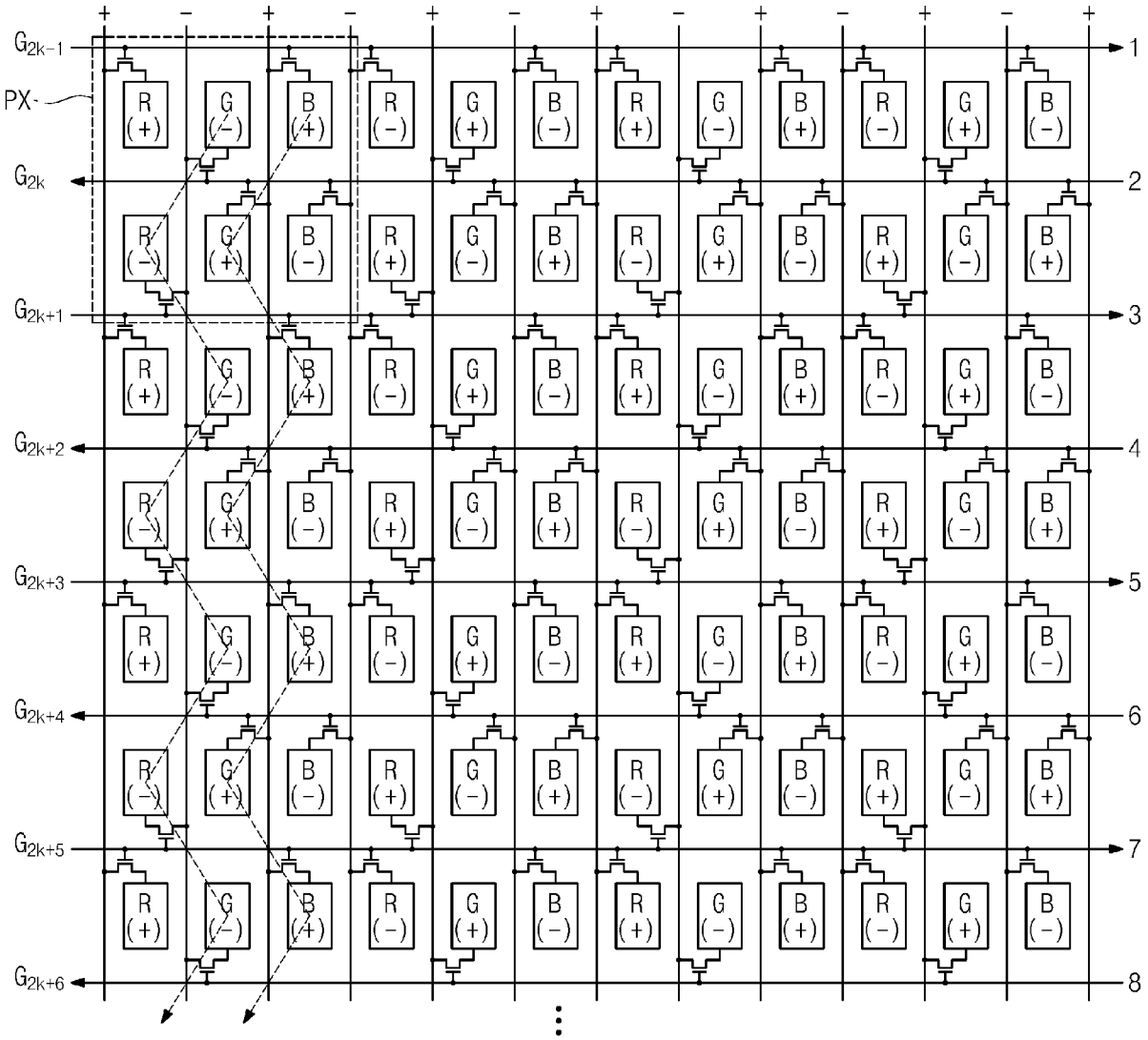
FIG. 7 is a plan view showing another exemplary embodiment of polarities of pixels shown in FIG. 2.

Hereinafter, an exemplary embodiment of a method of driving the display apparatus will be described with reference to FIGS. 6 and 7. FIGS. 6 and 7 show the gate lines $G_{2K-1}$ to $G_{2K+6}$ as an example.

The odd-numbered gate lines $G_{2K-1}$ to $G_{2K+5}$ transmit the gate signal in a direction different from a direction in which the even-numbered gate lines $G_{2K}$ to $G_{2K+6}$ transmit the gate signal. The odd-numbered gate lines $G_{2K-1}$ to $G_{2K+5}$ connected to the first gate driver 200L transmit the gate signal from the left side of the display panel DP to the right side of the display panel DP, and the even-numbered gate lines $G_{2K}$ to $G_{2K+6}$ connected to the second gate driver 200R transmit the gate signal from the right side of the display panel DP to the left side of the display panel DP.

The sub-pixels SPX including the red color filter R are applied with the same gate signal in the unit of row, and the sub-pixels SPX including the green color filter G are applied with the same gate signal in the unit of row.

In detail, the thin film transistors TFT related to the sub-pixels SPX arranged in the same column and including the same color filter are turned on during the same time period even though the sub-pixels SPX arranged in the same column and including the same color filter are arranged in different rows from each other. Thus, a horizontal line or a vertical line may be prevented from being perceived.

The data lines $D_1$ to $D_m$ may be divided into odd-numbered data lines and even-numbered data lines. As shown in FIG. 6, the odd-numbered-data lines receive the data signals having a polarity different from a polarity of the data signals applied to the even-numbered data lines. As an example, the odd-numbered data lines may be applied with the data signals having a positive (+) polarity and the even-numbered data lines may be applied with the data signals having a negative (−) polarity.

According to the connection relation of the sub-pixels SPX and the data lines $D_1$ to $D_m$, although the polarity of the data signals applied to the data lines is inverted in the unit of data line, the polarity of the data signals applied to the sub-pixels SPX is inverted in a dot-inversion scheme. That is, the sub-pixels SPX adjacent to each other are applied with the data signals having different polarities from each other. Accordingly, the polarities of the sub-pixels SPX applied with the data signals may be optimized, thereby improving the display quality of the display apparatus.

The first gate driver 200L sequentially applies the gate signal to the odd-numbered gate lines $G_{2K-1}$ to $G_{2K+5}$ and the second gate driver 200R sequentially applies the gate signal to the even-numbered gate lines $G_{2K}$ to $G_{2K+6}$.

As shown in FIG. 6, after the second gate driver 200R firstly outputs the gate signal to the first gate line $G_{2K}$ of the even-numbered gate lines $G_{2K}$ to $G_{2K+6}$, the first gate driver 200L secondly outputs the gate signal to the first gate line $G_{2K-1}$ of the odd-numbered gate lines $G_{2K-1}$ to $G_{2K+5}$.

Further, as shown in FIG. 7, after the first gate driver 200L firstly outputs the gate signal to the first gate line $G_{2K-1}$ of the odd-numbered gate lines $G_{2K-1}$ to $G_{2K+5}$, the second gate driver 200R secondly outputs the gate signal to the first gate line $G_{2K}$ of the even-numbered gate lines $G_{2K}$ to $G_{2K+6}$. In this case, the gate lines $G_{2K-1}$ to $G_{2K+6}$ sequentially receive the gate signals without any connection or relation between the gate lines $G_{2K-1}$ to $G_{2K+6}$ and the first and second gate drivers 200L and 200R.

Figure 8:
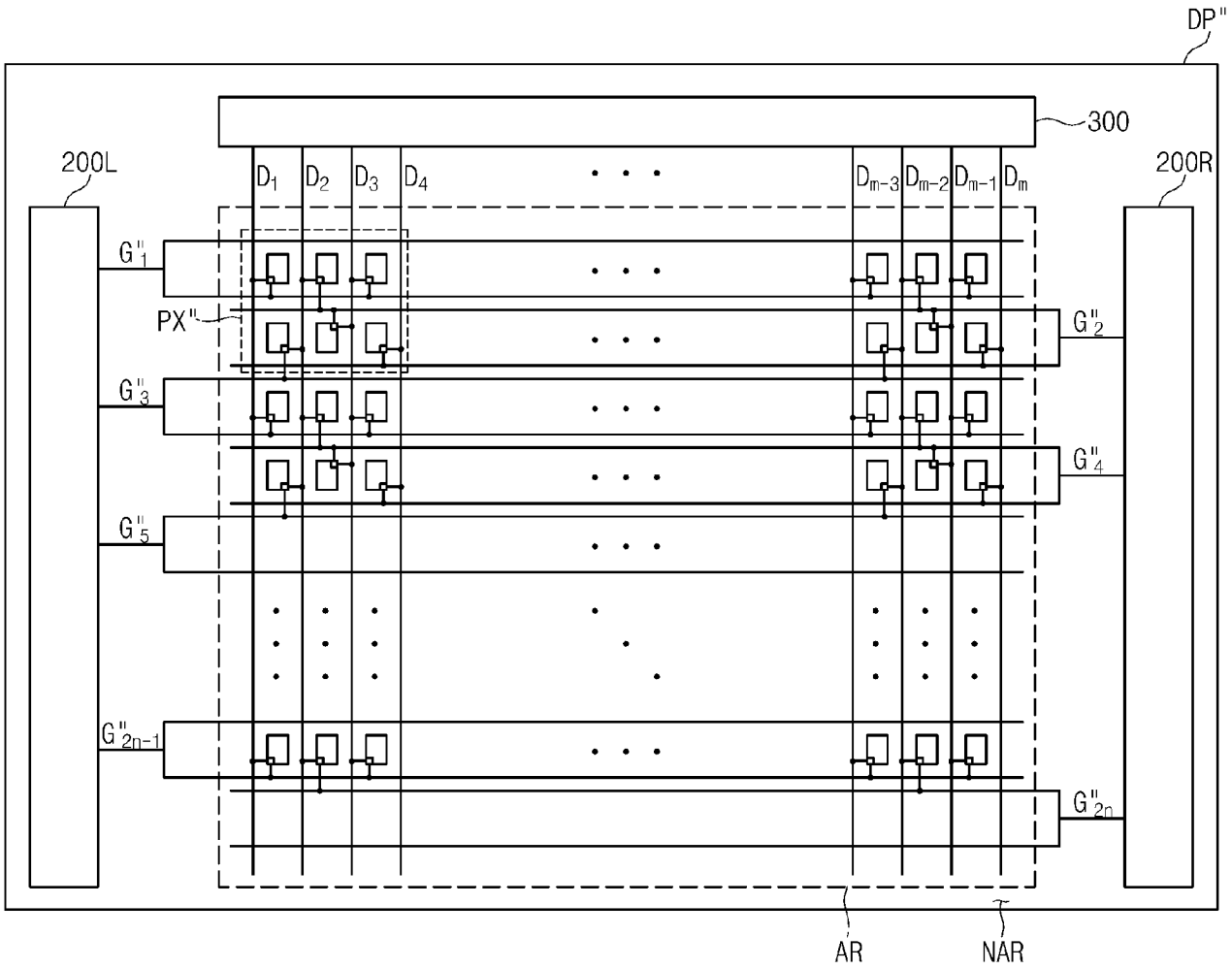
FIG. 8 is a plan view showing another exemplary embodiment of a display apparatus according to the invention.
Figure 9:
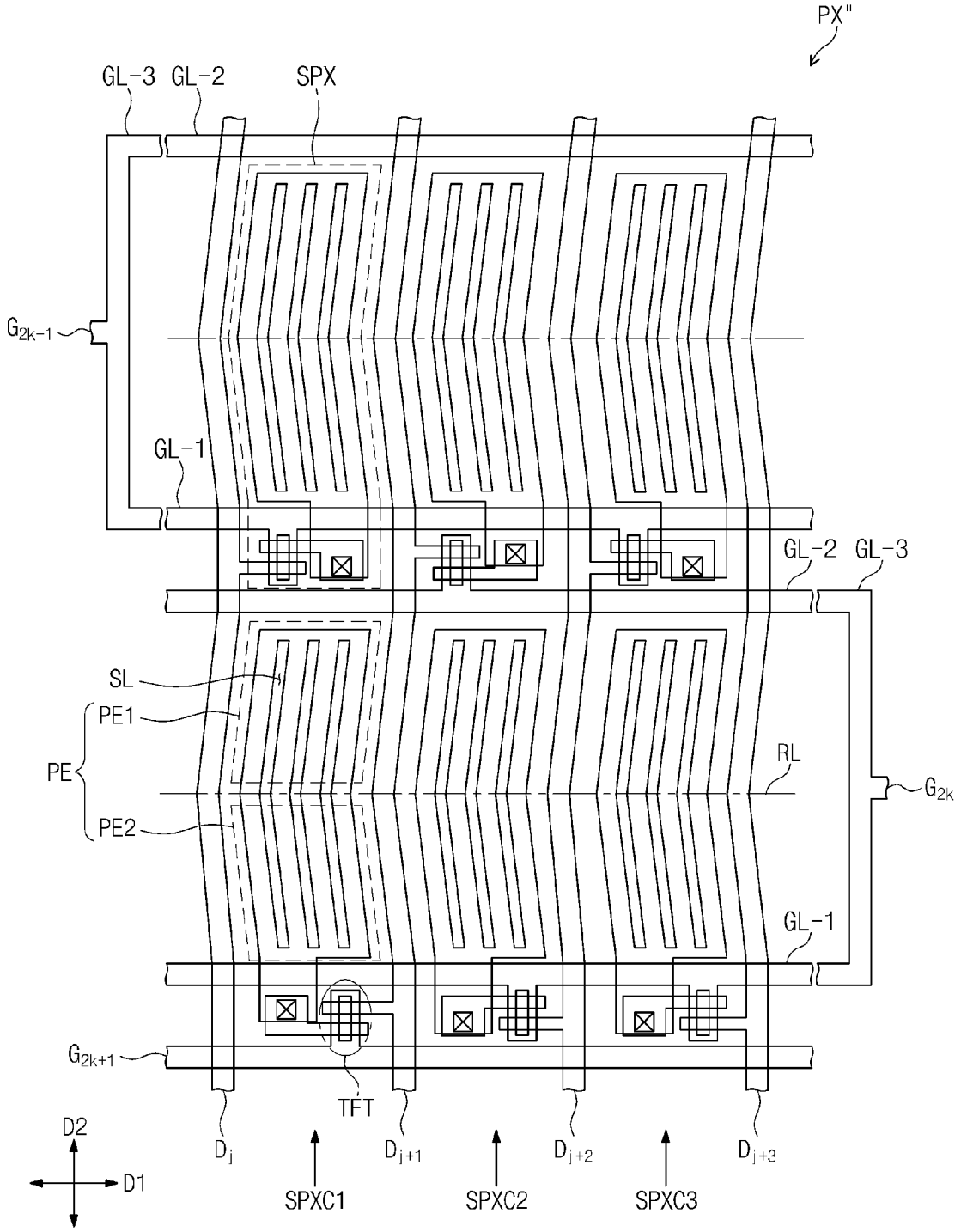
FIG. 9 is an enlarged plan view showing an exemplary embodiment of a pixel shown in FIG. 8.

FIG. 8 is a plan view showing another exemplary embodiment of a display apparatus according to the invention and FIG. 9 is an enlarged plan view showing an exemplary embodiment of a pixel shown in FIG. 8. In FIGS. 8 and 9, the same reference numerals denote the same elements in FIGS. 1 to 7, and thus detailed descriptions of the same elements will be omitted.

Referring to FIGS. 8 and 9, a display panel DP" includes the first substrate 10, and the second substrate 20 facing the first substrate 10. The first substrate 10 includes a plurality of gate lines $G''_1$ to $G''_{2n}$ and a plurality of data lines $D_1$ to $D_m$ crossing the gate lines $G''_1$ to $G''_{2n}$.

In the display area AR, a plurality of pixels PX" is arranged. Each of the pixels PX" includes sub-pixels SPX arranged in two rows by three columns. Each sub-pixel SPX includes a thin film transistor TFT, a pixel electrode PE and a common electrode CE.

As shown in FIGS. 8 and 9, each of the gate lines $G''_1$ to $G''_{2n}$ includes a first line portion GL-1, a second line portion GL-2, and a connection line portion GL-3. A first gate line $G''_1$ of the gate lines $G''_1$ to $G''_{2n}$ includes only the first line portion GL-1 directly connected to the first gate driver 200L and an n-th gate line G"n of the gate lines $G''_1$ to $G''_{2n}$ includes only the second line portion GL-2 directly connected to the second gate driver 200R.

The first line portion GL-1 is disposed adjacent to a first side of the pixel electrode PE and the second line portion GL-2 is disposed adjacent to a second side of the pixel electrode PE. Accordingly, the first line portion GL-1 and the second line portion GL-2 face each other while interposing the pixel electrode PE therebetween. The first line portion GL-1 and the second line portion GL-2 are disposed in the display area AR.

The connection line portion GL-3 is disposed in the non-display area NAR to connect the first line portion GL-1 and the second line portion GL-2. The connection line portion GL-3 is connected to one of the gate drivers 200L and 200R.

As described with reference to FIG. 9, the sub-pixels SPX arranged in one column of three columns are connected to one gate line among the three successive gate lines. In this case, the expression that "the sub-pixel is connected to the gate line" means that the thin film transistor included in the sub-pixel is connected to the gate line.

One sub-pixel of the sub-pixels arranged in the one column is connected to the first line portion GL-1 of the one gate line and a remaining one sub-pixel of the sub-pixels arranged in the one column is connected to the second line portion GL-2.

In the exemplary embodiment, for instance, as shown in FIG. 9, the sub-pixel SPX arranged in the second column SPXC2 and the first row is connected to the second line portion GL-2 of the second gate line $G_{2K}$, and the sub-pixel SPX arranged in the second column SPXC2 and the second row is connected to the first line portion GL-1 of the second gate line $G_{2K}$.

The sub-pixels SPX arranged in the first column SPXC1 may be connected to different gate lines from each other. The sub-pixel SPX arranged in the first column SPXC1 and the first row may be connected to the first line portion GL-1 of the first gate line $G_{2K-1}$, and the sub-pixel SPX arranged in the first column SPXC1 and the second row may be connected to the second gate line $G_{2K+1}$.

Each pixel PX" according to the exemplary embodiment includes a pixel electrode PE including a plurality of slits SL. In addition, the pixel electrode PE may be divided into first and second portions PE1 and PE2 with reference to a reference line RL.

The first portion PE1 may have the same planar area as that of the second portion PE2. The reference line RL is positioned at the same position of each of the sub-pixels SPX arranged in the same row among the sub-pixels SPX arranged in two rows by three columns Although the exemplary embodiments of the invention have been described, it is understood that the invention should not be limited to these exemplary embodiments but various changes and modifications can be made by one ordinary skilled in the art within the spirit and scope of the invention as hereinafter claimed.

What is claimed is:

1. A display apparatus comprising:

a first substrate including a display area which displays an image, and a non-display area adjacent to the display area;

a plurality of gate lines which is on the first substrate and receives a gate signal;

a plurality of data lines which is on the first substrate and receives a data signal, wherein the data lines are insulated from the gate lines and cross the gate lines; and a plurality of pixels, each of the pixels including sub-pixels in two successive rows by three successive columns, wherein, among the sub-pixels in the two successive rows by the three successive columns, the sub-pixels in one of the three successive columns are respectively connected to a first pair of different gate lines among three successive gate lines and display a first color, and the sub-pixels in a different one of the three successive columns are connected to a remaining gate line among the three successive gate lines and display a second color different from the first color.

2. The display apparatus of claim 1, wherein the sub-pixels in a remaining one of the three columns are respectively connected to a second pair of different gate lines among the three gate lines and display a third color different from the first color and the second color.

3. The display apparatus of claim 2, wherein the sub-pixels in a same column are connected to two data lines, which are respectively adjacent to the sub-pixels in the same column, among the data lines.

4. The display apparatus of claim 3, wherein the gate lines are divided into odd-numbered gate lines and even-numbered gate lines, and the odd-numbered gate lines transmit the gate signal in a first direction different from a second direction in which the even-numbered gate lines transmit the gate signal.

5. The display apparatus of claim 4, wherein the data lines are divided into odd-numbered data lines and even-numbered data lines, the odd-numbered data lines receive the data signal having a positive polarity or a negative polarity, and the even-numbered data lines receive the data signal having a polarity different from that of the odd-numbered data lines.

6. The display apparatus of claim 4, further comprising:

a first gate driver which is in the non-display area and applies the gate signal to the odd-numbered gate lines; and a second gate driver which is in the non-display area and applies the gate signal to the even-numbered gate lines.

7. The display apparatus of claim 6, wherein each of the sub-pixels displaying the first color in a single one of the three columns comprises a red color filter, and each of the sub-pixels displaying the second color in a different single one of the three columns comprises a green color filter.

8. The display apparatus of claim 7, wherein each of the sub-pixels displaying the third color in a remaining single one of the three columns comprises a blue color filter.

9. The display apparatus of claim 6, wherein the first gate driver sequentially applies the gate signal to the odd-numbered gate lines, the second gate driver sequentially applies the gate signal to the even-numbered gate lines, and the second gate driver applies the gate signal to a first gate line of the even-numbered gate lines after the first gate driver applies the gate signal to a first gate line of the odd-numbered gate lines.

10. The display apparatus of claim 6, wherein the first gate driver sequentially applies the gate signal to the gate lines which transmit the gate signal in the first direction, and the second gate driver sequentially applies the gate signal to the gate lines which transmit the gate signal in the second direction.

11. The display apparatus of claim 1, further comprising;

a second substrate which faces the first substrate; and a liquid crystal layer between the first substrate and the second substrate.

12. The display apparatus of claim 11, wherein each of the sub-pixels in the two successive rows by the three successive columns comprises:

a thin film transistor which outputs the data signal in response to the gate signal;

a pixel electrode including a first portion, a second portion which continuously extends from the first portion and a plurality of slits, wherein the pixel electrode receives the data signal; and a common electrode between the thin film transistor and the pixel electrode.

13. The display apparatus of claim 12, wherein the thin film transistor comprises:

a gate electrode which protrudes from one of the gate lines in a first direction, when viewed in a plan view;

an active layer on the gate electrode;

a source electrode which is on the active layer, protrudes from one of the data lines in a second direction which crosses the first direction when viewed in the plan view, and partially overlaps the gate electrode; and a drain electrode which is on the active layer, spaced apart from the source electrode in the first direction, extends in the second direction and overlaps the gate electrode.

14. The display apparatus of claim 13, wherein the active layer comprises a metal oxide material having a semiconductor property.

15. The display apparatus of claim 12, wherein a planar area of the first portion of the pixel electrode is greater than a planar area of the second portion of the pixel electrode.

16. The display apparatus of claim 15, wherein a reference line divides the pixel electrode into the first portion and the second portion is at a same position of each of the sub-pixels in a same row of the sub-pixels, and one of the sub-pixels among sub-pixels in the same row and in adjacent columns to each other includes the first portion above the reference line and the second portion below the reference line, and a remaining one of the sub-pixels in the same row and in the adjacent columns includes the second portion above the reference line and the first portion below the reference line.

17. The display apparatus of claim 12, wherein each of the gate lines comprises:

a first line portion adjacent to a first side of the pixel electrode in a plan view;

a second line portion adjacent to a second side opposite to the first side of the pixel electrode, in the plan view; and a connection line portion which is in the non-display area and connects the first line portion and the second line portion.

18. The display apparatus of claim 17, wherein one of the sub-pixels displaying the second color in the different one of the three successive columns is connected to the first line portion, and a remaining one of the sub-pixels displaying the second color in the different one of the three successive columns is connected to the second line portion.

19. The display apparatus of claim 18, wherein a planar area of the first portion is the same as a planar area of the second portion.

20. A display apparatus comprising:

a first substrate including a display area which displays an image, and a non-display area adjacent to a portion of the display area;

a plurality of gate lines which is on the first substrate and receives a gate signal;

a plurality of data lines which is on the first substrate and receives a data signal, wherein the data lines are insulated from the gate lines and cross the gate lines; and a plurality of pixels on the first substrate, each of the pixels including sub-pixels in two successive rows by three successive columns, wherein, among the sub-pixels in the two successive rows by the three successive columns, the sub-pixels in one of the three successive columns are respectively connected to a first pair of different gate lines among three successive gate lines, and the first pair of different gate lines transmit the gate signal in a first direction along pixel rows, and the sub-pixels in a different one of the three successive columns are connected to a remaining gate line among the three successive gate lines, and the remaining gate line transmits the gate signal in a second direction different from the first direction along the pixel rows.

* * * * *